US005143440A

United States Patent [19]

Trampota

[11] Patent Number: 5,143,440

[45] Date of Patent: Sep. 1, 1992

[54] ILLUMINATED LUNCH BOX

[76] Inventor: Clinton D. Trampota, 118 Cumberland Gap, Victoria, Tex. 77904

[21] Appl. No.: 818,247

[22] Filed: Jan. 8, 1992

[51] Int. Cl.[5] ..... A45C 15/06

[52] U.S. Cl. ..... 362/156; 362/154

[58] Field of Search ..... 362/154, 155, 156, 253

[56] References Cited

U.S. PATENT DOCUMENTS

| | | | |
|---|---|---|---|
| 1,227,893 | 5/1917 | Delzell | 362/156 |
| 1,309,541 | 7/1919 | O'Neel | 362/156 |
| 2,334,084 | 11/1943 | Gold et al. | 362/156 |
| 4,855,881 | 8/1989 | Pence | 362/154 X |

*Primary Examiner*—Stephen F. Husar
*Attorney, Agent, or Firm*—Leon Gilden

[57] ABSTRACT

A lunch box is arranged to provide for illumination during conditions of limited available light, whererin the lunch box includes an upper housing pivotally mounted to a lower housing, with the illumination chamber positioned to a top wall of the upper housing and operative through a switch positioned rearwardly of the illumination housing relative to an associated handle. An electrically transmissive hinge is mounted between the upper housing and lower housing to direct electrical communication between batteries mounted within the lower housing to the illumination chamber within the upper housing.

4 Claims, 4 Drawing Sheets

ILLUMINATED LUNCH BOX

BACKGROUND OF THE INVENTION

1. Field of the Invention

The field of invention relates to lunch box apparatus, and more particularly pertains to a new and improved illuminated lunch box wherein the same is arranged to provide for selective illumination during use.

2. Description of the Prior Art

Typically, campers and the like find themselves within various situations requiring availability in use of an associated lunch box structure. The prior art, while availing itself of various associations with a lunch box, has heretofore failed to provide for an illuminated lunch box formed of a waterproof type construction arranged for provision of artificial available light as required.

Prior art lunch box structure utilizing a radio system is exemplified in U.S. Pat. No. 4,939,912 to Leonovich, Jr., as well as the U.S. Pat. No. 4,817,191 Adams.

Accordingly, it may be appreciated that there continues to be a need for a new and improved illuminated lunch box as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of lunch box apparatus now present in the prior art, the present invention provides an illuminated lunch box wherein the same is arranged to provide for illumination during use of the lunch box structure. As such, the general purpose of the present invention, which will be described subsequently in greater detail, is to provide a new and improved illuminated lunch box which has all the advantages of the prior art lunch box apparatus and none of the disadvantages.

To attain this, the present invention provides a lunch box arranged for illumination during conditions of limited available light, wherein the lunch box includes an upper housing pivotally mounted to a lower housing, with illumination chamber positioned to a top wall of the upper housing and operative through a switch positioned rearwardly of the illumination housing relative to an associated handle. An electrically transmissive hinge is mounted between the upper housing and lower housing to direct electrical communication between batteries mounted within the lower housing to the illumination chamber within the upper housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved illuminated lunch box which has all the advantages of the prior art lunch box apparatus and none of the disadvantages.

It is another object of the present invention to provide a new and improved illuminated lunch box which may be easily and efficiently manufactured and marketed.

It is a further object of the present invention to provide a new and improved illuminated lunch box which is of a durable and reliable construction.

An even further object of the present invention is to provide a new and improved illuminated lunch box which is susceptible of a low cost of manufacture with regard to both materials and labor, and which accordingly is then susceptible of low prices of sale to the consuming public, thereby making such illuminated lunch boxes economically available to the buying public.

Still yet another object of the present invention is to provide a new and improved illuminated lunch box which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understaning of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
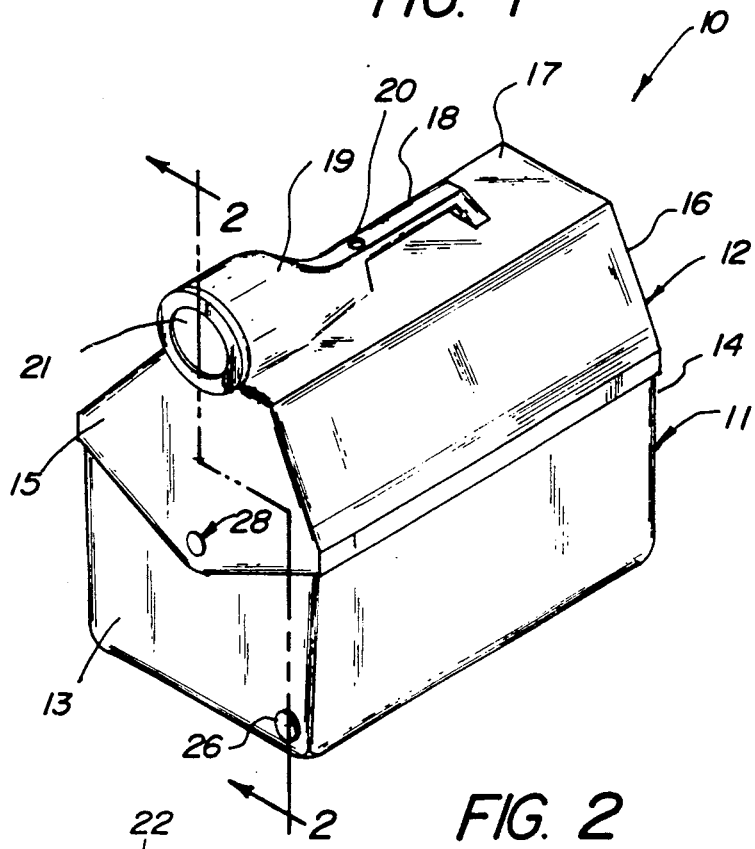
FIG. 1 is an isometric illustration of the instant invention.
Figure 2:
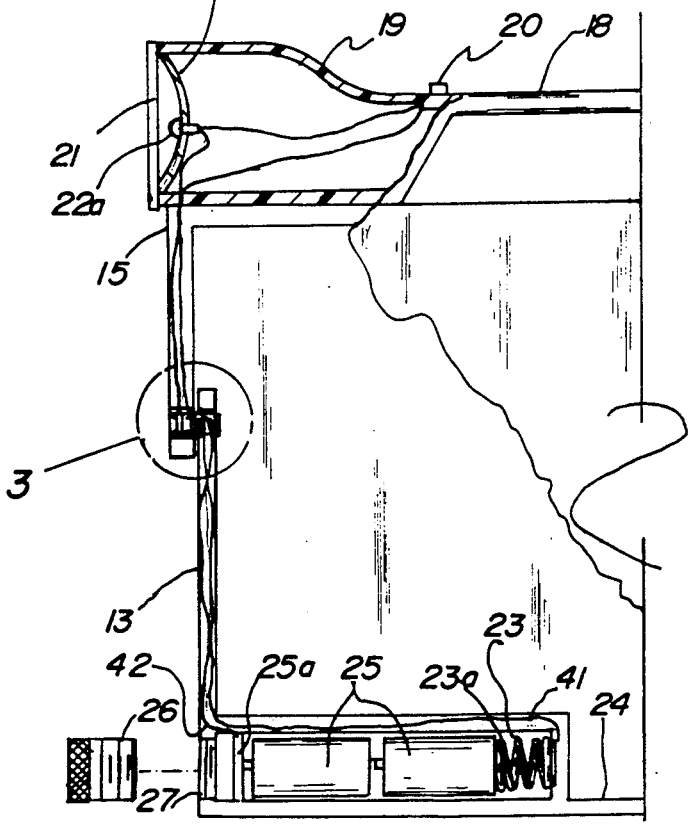
FIG. 2 is an orthographic view, taken along the lines 2—2 of FIG. 1 in the direction indicated by the arrows.
Figure 3:
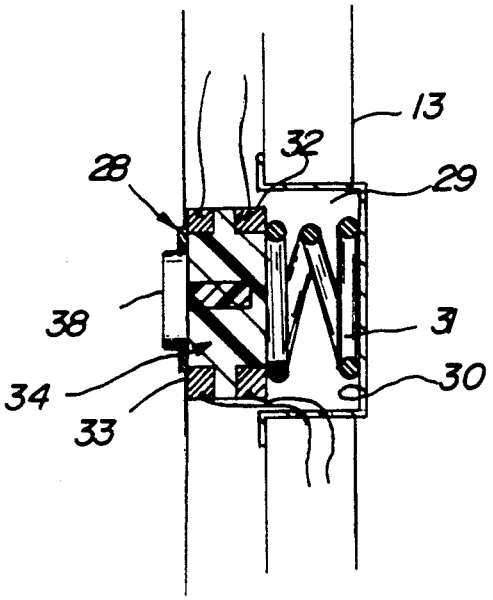
FIG. 3 is a cross-sectional view of section 3 as set forth in FIG. 2.
Figure 4:
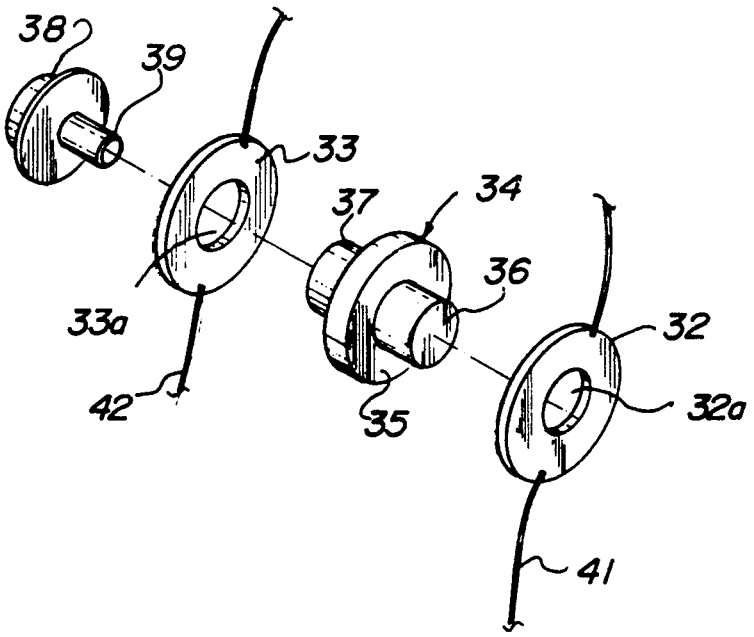
FIG.4 is an isometric exploded illustration of the electrical transmissive hinge of the invention.

With reference now to the drawings, and in particular to FIGS. 1 to 7 thereof, a new and improved illuminated lunch box embodying the principles and concepts of the present invention and generally designated by the reference numerals 10 and 10*a* will be described.

More specifically, the illuminated lunch box 10 of the instant invention as depicted in FIG. 1 includes a lower container shell 11 formed of a fluid impermeable material of unitary construction and pivotally mounted to an upper container shell 12, also of a fluid impermeable and unitary construction. The lower container includes a lower container front wall 13 spaced from a lower container rear wall, with an upper container front wall spaced from a container rear wall, with the lower container front wall pivotally mounted to the upper container front wall and the lower container rear wall pivotally mounted to the upper container rear wall, with an upper container top wall 17 extending between the lower container front wall and the lower container rear wall. A handle 18 is fixedly and orthogonally mounted medially of the upper container top wall, with an illumination housing 19 extending longitudinally of the handle 18 extending to the upper container front wall 15. The illumination housing includes a transparent lens 21, with an illumination bulb 22*a* positioned rearwardly of the transparent lens 21 and mounted medially and coaxially within a concave reflector 22 (see FIG. 2). A switch 20 mounted adjacent an intersection of the illumination housing 19 and the handle 18 is operative to effect selective actuation of the bulb 22*a* effecting electrical communication between at least one and preferably a plurality of batteries 25 contained within a battery well 23. The battery well 23 is accessed through the lower container front wall 13 through a removable plug 26 that is removably mounted within an access bore 27 positioned adjacent the lower housing floor 24. A battery well spring 23*a* is captured between the batteries 25 and a rear wall of the well 23, wherein a battery plate 25*a* of electrical transmissive material is secured between the removal plug 26 and the batteries 25. An electrically transmissive hinge 28 hingedly mounts the lower container front wall 13 to the upper container front wall 15. The electrically transmissive hinge (see the FIGS. 3 and 4) includes a support cavity 29 mounted through the lower container front wall 13, including a support cavity floor 30. A support cavity spring 31 is mounted to the floor 30 and biases a button head 38, a first electrical disc 32, a second electrical disc 33, and a support boss 34 positioned medially of the discs 32 and 33. The first electrical disc 32 includes electrical transmission of a first electrical wire 41 that is directed from the battery well spring 23*a* to the first electrical disc 32 and from the first electrical disc 32 to the switch 20. A second electrical wire 42 is directed from the battery plate 25*a* to the second electrical disc 33 and subsequently to the illumination bulb 22*a* and to the switch 20. In this manner, rotation of the wires 41 and 42 is not required when directed from the lower container shell 11 to the upper container shell 12 maintaining longevity and proper alignment of the wires during use of the organization. The first electrical disc 32 includes a first electrical disc bore 32*a*, wherein the second electrical disc 33 includes a second electrical disc bore 33*a* coaxially aligned with the first electrical disc bore 32*a* . The support boss 34 includes a central plate 35 positioned medially of the first and second electrical disc 32 and 33, with a first hub and second hub 36 and 37 respectively projecting on opposed sides of the central plate 35 as the first hub and second hub are coaxially aligned to receive the first electrical disc bore 32*a* and the second electrical disc bore 33*a* respectively thereabout. A button head 38 including a button head shaft 39 received coaxially through the second hub 37 into the support boss 34 aligns the electrical hinge together. Further, projection of the button head 38 into the support cavity 29 displaces the button head 38 relative to the lower container front wall 13. The first and second electrical wires 41 and 42 are directed through the lower container bottom front wall 13 extending through the hinge 28 and extending through the upper container front wall 15.

Figure 5:
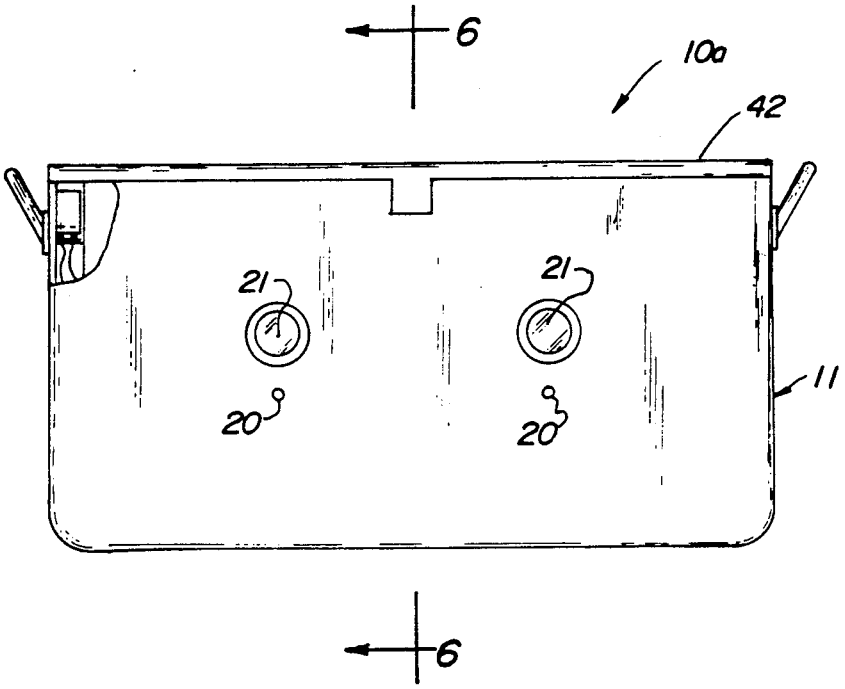
FIG. 5 is an orthographic front view of a modified lunch box structure.
Figure 6:
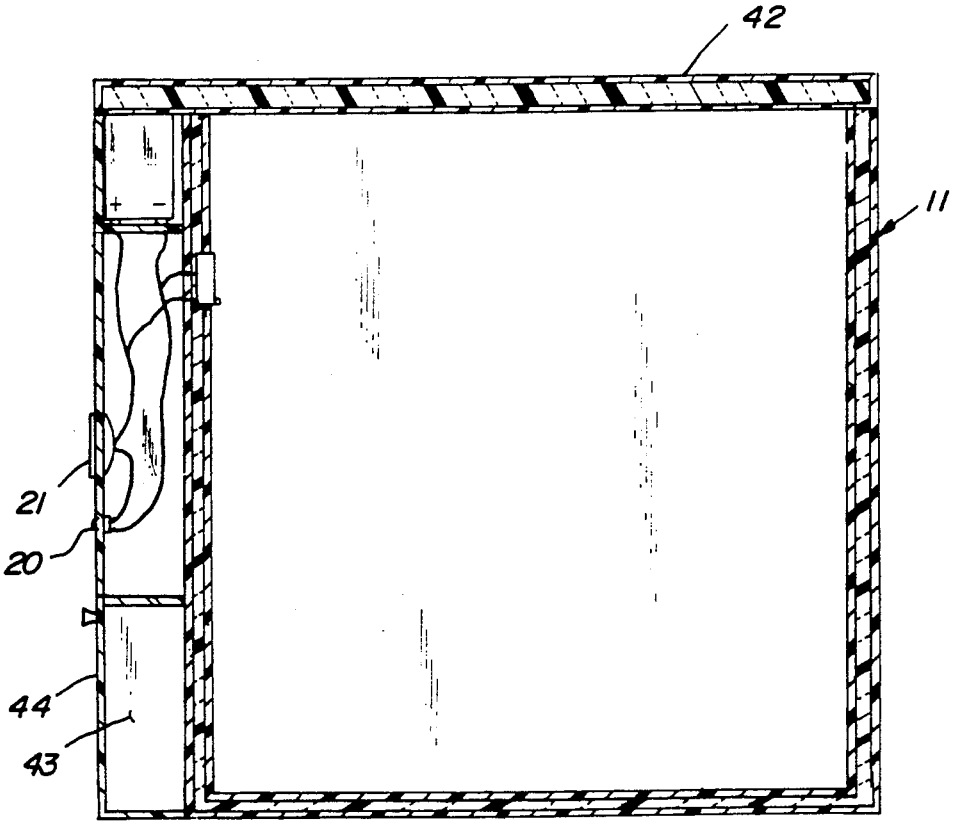
FIG. 6 is an orthograpic view, taken along the lines 6—6 of FIG. 5 in the direction indicated by the arrows.
Figure 7:
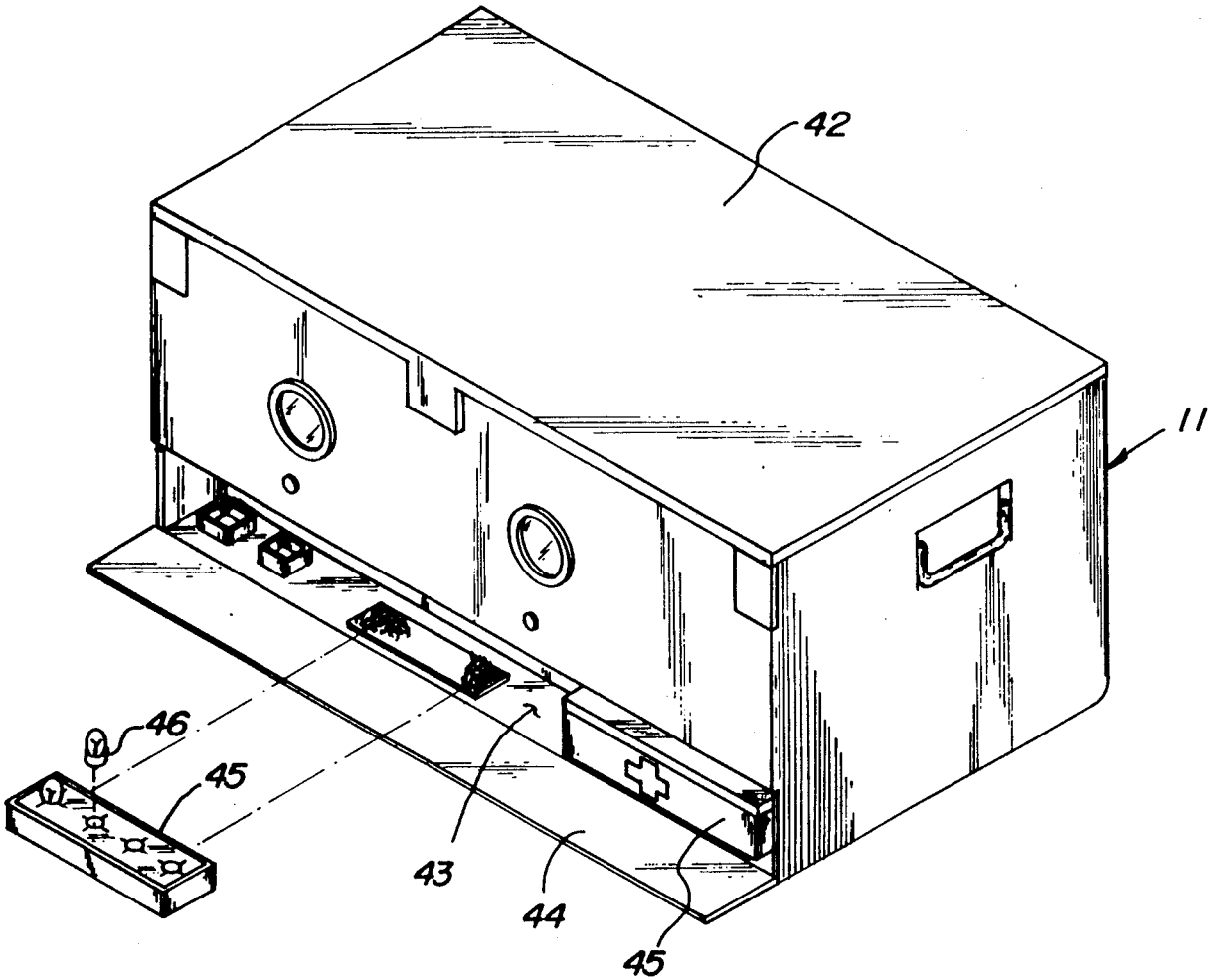
Fig. 7 is an isometric illustration of the lunch box construction of the FIG. 5.

The apparatus 10*a*, as illustrated in the FIGS. 5–7, includes a lid 42 mounted to the lower container shell 11, with a plurality of illumination lenses 21 and associated switches 20 mounted in the front wall. A lower compartment 43 includes a lower compartment door 44 removably mounted relative to the front wall for access to the compartment 43 to include a first aid kit, spare bulb holders and bulbs 46 and the like. It should be further noted that the lunch box 10 and the lunch box 10*a* may be further provided with reflector members as desired and additionally, a flasher unit cooperative with illumination housing if desired. Further, if desired, illumination within the container well is optionally available, as illustrated in FIG. 6, by way of an illumination member 49 operative through one or both of the switches 20.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated lunch box, comprising, a lower container shell, including an upper container shell hingedly mounted to the lower container shell, with the lower container shell including a lower container front wall spaced from and parallel a lower container rear wall, and the upper container shell including an upper container shell front wall parallel to an upper container raer wall, with the upper container front wall hingedly mounted to and parellel the lower container front wall, and the upper container rear wall hingedly mounted to and parallel the lower container rear wall, and the upper container including an upper container top wall extending between the upper container front wall and the upper container rear wall, and the lower container including a lower container floor extending between the lower container front wall and the lower container rear wall, and a handle mounted medially and fixedly to the upper container top wall, and an illumination housing mounted to the upper container top wall longitudinally aligned with the handle, with the illumination housing extending to the upper container front wall, and a switch mounted at an intersection of the illumination housing and the handle in operative communication with a plurality of batteries mounted within the lower container to effect selective illumination of the illumination housing.

2. An apparatus as set forth in claim 1 wherein the lower container includes a battery well positioned contiguous with the lower container floor, with the battery well including an access bore directed through the lower container front wall coaxially aligned with the battery well, with the battery well including the batteries contained therewithin, and a battery well spring mounted within the battery well and a battery plate mounted adjacent the plug, wherein the batteries are positioned between the battery well spring and the battery plate.

3. An apparatus as set forth in claim 2 including an electrically transmissive hinge mounted adjecent a lower disal end of the upper container front wall and adjacent an upper distal end of the lower container front wall, wherein the electrically transmissive hinge is directed through the lower container front wall and the upper container front wall, and a first electrical wire directed from the battery well spring to the electrically transmissive hinge, and wherein the first electrical wire is directed from the electrically transmissive hinge to the switch, and a second electrical wire directed from the battery plate to the electrically transmissive hinge, and wherein the second electrical wire is directed from the electrically transmissive hinge to the illumination housing, and the second electrical wire is directed from the illumination housing to the switch.

4. An apparatus as set forth in claim 3 wherein the electrically transmissive hinge includes a support cavity directed into the lower container front wall, the support cavity including a support cavity floor, and a support cavity spring mounted to the support cavity floor, and a first electrical disc positioned in contiguous communication with the support cavity spring, the first electrical disc including a first electrical disc bore, and a support boss receiving the first electrical disc, with the support boss including a central plate, the central plate including a first hub, the first hub is directed into the first electrical disc bore, and the central plate includes a second hub, the second hub coaxially aligned with the first hub, and a second electrical disc including a second electrical disc bore, the second electrical disc bore directed about the second hub, and a button head mounted to the central plate through the second hub, wherein the button head projects through the upper container front wall, and the first electrical wire is directed to the first electrical disc, and the second electrical wire is directed to the second electrical disc.

* * * * *